US005509219A

United States Patent [19]

Mecca

[11] Patent Number: 5,509,219

[45] Date of Patent: Apr. 23, 1996

[54] LIGHT WEIGHT PORTABLE SNOW PLOW

[76] Inventor: Leonard W. Mecca, 117 Ocean Dunes Cir., Jupiter, Fla. 33477

[21] Appl. No.: 332,798

[22] Filed: Nov. 2, 1994

[51] Int. Cl.[6] ..... E01H 5/04

[52] U.S. Cl. ..... 37/231; 37/279

[58] Field of Search ..... 37/231, 279, 271, 37/270, 266, 287, 272, 277, 263, 214; 172/811, 816, 817

[56] References Cited

U.S. PATENT DOCUMENTS

| | | | |
|---|---|---|---|
| 3,448,534 | 6/1969 | Pipes . | |
| 3,760,883 | 9/1973 | Birk . | |
| 4,304,056 | 12/1981 | Watson . | |
| 4,574,502 | 3/1986 | Blau | 37/266 |
| 4,754,562 | 7/1988 | McGarrah . | |
| 4,843,744 | 7/1989 | Jansen | 37/232 |
| 4,944,104 | 7/1990 | Kowalczyk | 37/231 |
| 4,962,598 | 10/1990 | Woolhiser . | |
| 4,976,053 | 12/1990 | Caley . | |
| 5,036,608 | 8/1991 | Clula . | |
| 5,111,603 | 5/1992 | Knowhan . | |
| 5,125,174 | 6/1992 | Watson . | |
| 5,129,170 | 7/1992 | Fusilli . | |
| 5,136,795 | 8/1992 | Rosenberg . | |
| 5,193,296 | 3/1993 | Reilley . | |
| 5,195,261 | 3/1993 | Vachoa . | |
| 5,207,010 | 5/1993 | Grossman . | |
| 5,251,390 | 10/1993 | Wong . | |

*Primary Examiner*—Terry Lee Melius
*Assistant Examiner*—Robert Pezzato

[57] ABSTRACT

A Light Weight Portable Snow Plow for a vehicle having a bumper. The single piece blade is mounted on top of two tubular U-hooks. Each U-hook is inserted into molded pockets on the back of the blade. The U-hooks, in turn, are attached through hubs to a lower tubular U-support. The lower U-support extends downward and rests on the vehicle bumper. An upper U-support is also attached to the hubs. The upper support extends over and rests on the vehicle hood or trunk lid. Support straps are also attached to the hubs. At the distal end of the support straps are hooks to attach the straps to the vehicle wheel well and in turn the tubular supports and the blade to the front or rear of the vehicle. The vehicle bumper engages the rear of the bottom U-support to push the supports and thus the blade. The width of the U-hooks are different causing the blade to sit at an angle to the vehicle. The angle of the blade forces snow to one side as the vehicle moves.

1 Claim, 7 Drawing Sheets

LIGHT WEIGHT PORTABLE SNOW PLOW

BACKGROUND OF THE INVENTION

1. Field of the Invention

This invention relates, generally, to the field of detachable snow plow assemblies for motor vehicles. It relates more specifically to such detachable snow plows that are designed for periodic light or homeowner use. Thus the field most directly related to this invention encompasses snow plow assemblies that are light weight, easily attachable or detachable without the use of tools, inexpensive, and easily stored.

2. Description of the Prior Art

It is well established that a large percentage of the population lives in the vast geographical region known as the "snow belt." In fact, population estimates for the Northeast U.S. alone top fifty one million. Repeated winter snow storms in this region affect not only the general health of the population, but also the economy of the area. Prolonged exposure to severe weather to clear a home driveway can cause serious injury. Typically, this results in the driveway not being cleared until the accumulation of snow requires commercial snow removal at considerable expense. The time spent hand shoveling a driveway or waiting for commercial snow removal service results in lost time at a cost of hundreds of millions of dollars to both individuals and businesses.

Snow plow assemblies for the attachment to vehicles is of course well known in the art. Usually, however, these snow plows require the permanent installation of hardware on the vehicle. Furthermore, they are attached with a series of chains, nuts, and bolts requiring both tools and considerable time to install. None of these devices were intended to be installed by a one hundred pound housewife.

Several different approaches have been tried in rectifying this problem. The prior art U.S. Pat. Nos. 3,448,534-Pipes; 3,760,883-Birk; 4,304,056-Watson; 4,754,562-McGarrah; 4,944,104-Kowalczyk; 4,962,598-Woolhiser; 4,976,053-Caley; 5,036,608-Clula; 5,111,603-Knowhan; 5,125,174-Watson; 5,129,170-Fusilli; 5,136,795-Rosenberg; 5,193,296 -Reilley; 5,195,261 -Vachoa; 5,207,010-Grossman; and 5,251,390-Wong all relate to snow plow assemblies.

In the case of McGarrah, Woolhiser, Caley, Clula, Knowhan, Watson, Fusilli, Reilley, Vachoa, and Wong all require either the drilling of holes in the vehicle and/or the permanent installation of hardware on the vehicle.

In the case of Pipes, Watson, and Rosenberg all are relatively expensive, heavy, and require a considerable amount of time to install.

In the case of Birk, this invention was not intended for use on the standard homeowner automobile.

In the case of Grossman, this invention is not durable enough to withstand repeated use in snow.

In the case of Kowalczyk, this invention can not be installed by a single moderately capable person.

Another disadvantage of all of these prior arts is the need for tools and some degree of expertise to install them.

SUMMARY OF THE INVENTION

Accordingly, several objects and advantages of my invention are:

(a) to provide a Light Weight Portable Snow Plow that can be easily installed and removed;

(b) to provide a Light Weight Portable Snow Plow that can be installed by hand without the use of additional tools;

(c) to provide a Light Weight Portable Snow Plow that can be attached to a variety of different automobile bumpers;

(d) to provide a Light Weight Portable Snow Plow whose shape plows snow to one side of the driveway;

(e) to provide a Light Weight Portable Snow Plow constructed of one piece molded plastic;

(f) to provide a Light Weight Portable Snow Plow whose bottom lip is designed to push the plow upward if a small obstacle is encountered;

(g) to provide a Light Weight Portable Snow Plow that is installed using hardware similar to portable bicycle mounts;

(h) to provide a Light Weight Portable Snow Plow constructed of inexpensive materials using inexpensive manufacturing techniques allowing for a very low retail price;

(i) to provide a Light Weight Portable Snow Plow that can easily be installed by any member of the household;

(j) to provide a Light Weight Portable Snow Plow whose attachment to the vehicle is done through "shear pins" that are designed to break if an obstacle is encountered, preventing damage to the vehicle.

Further objects and advantages of my invention will become apparent from a consideration of the drawings and ensuing description.

REFERENCE NUMERALS IN DRAWINGS

10 Top Support Arm Cushion
11 Right Support Arm Cushion
12 Left Support Arm Cushion
13 Bottom Support Arm Cushion
14 Upper-Right Support Arm
15 Upper-Left Support Arm
16 Lower-Right Support Arm
17 Lower-Left Support Arm
18 Bottom Support Arm
19 Top Support Arm
20 Plow Blade
21 Shear Pin Nut
22 Shear Pin
23 Domed Washer 24 Radially-Ribbed Hub 25 Support Straps 26 Strap Buckle 27 Strap Hook

DESCRIPTION OF THE PREFERRED EMBODIMENT

Figure 1:
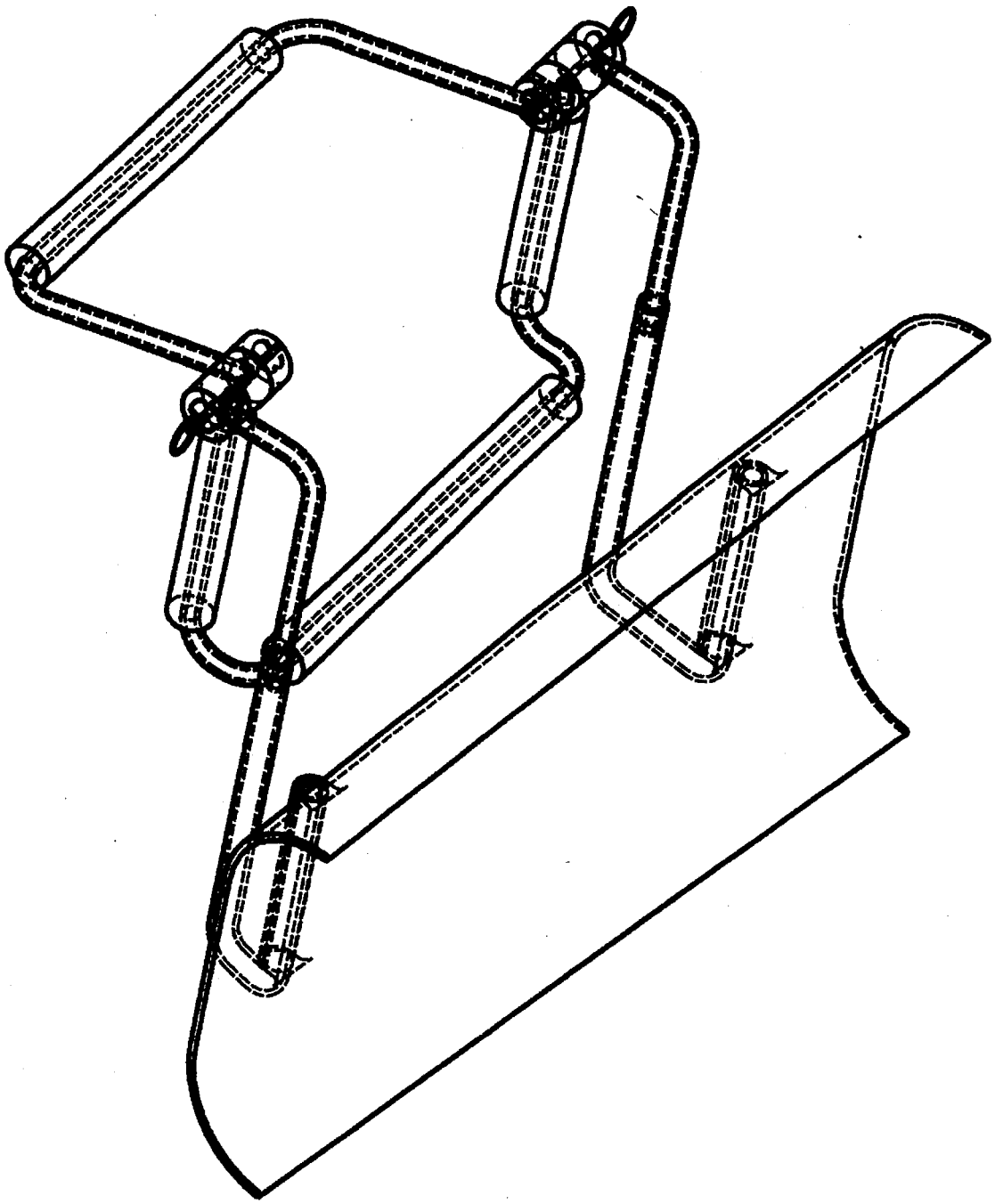
FIG. 1 is a perspective view of a Light Weight Portable Snow Plow.
Figure 2:
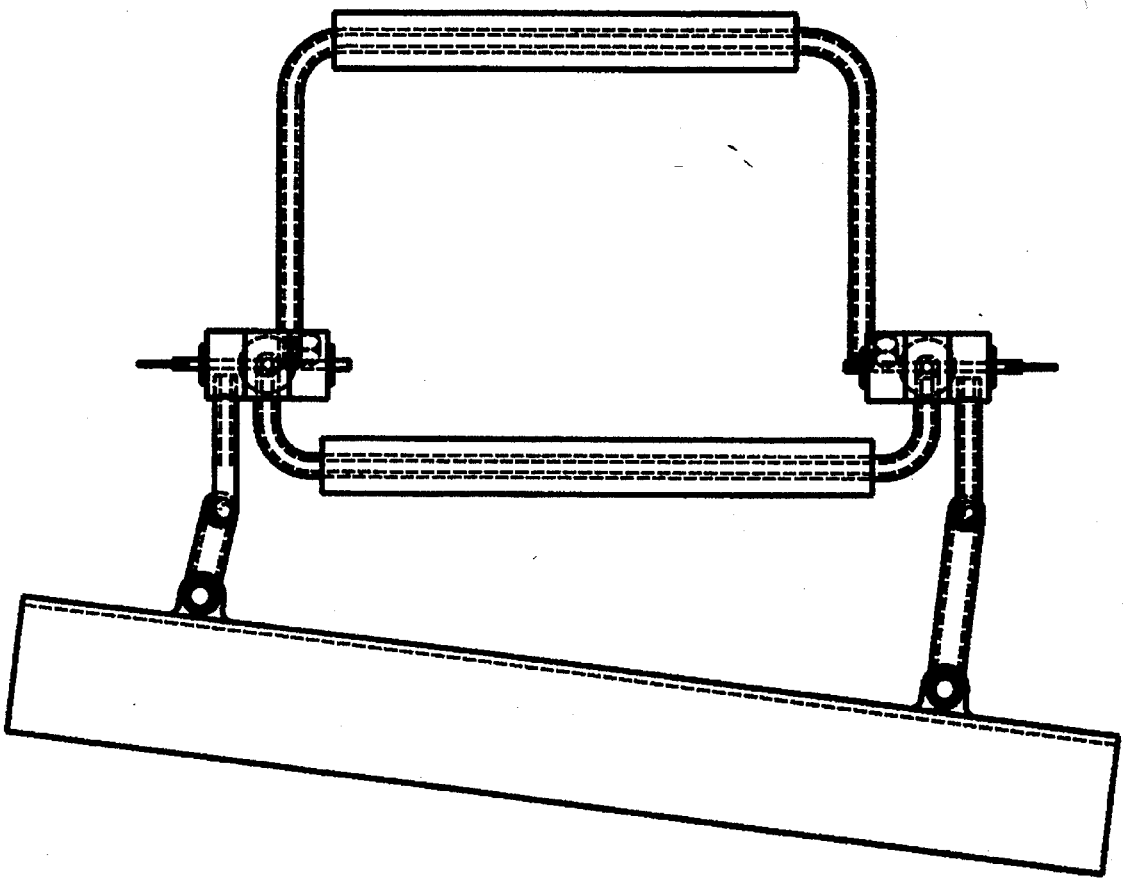
FIG. 2 is a plan view of a Light Weight Portable Snow Plow.
Figure 3:
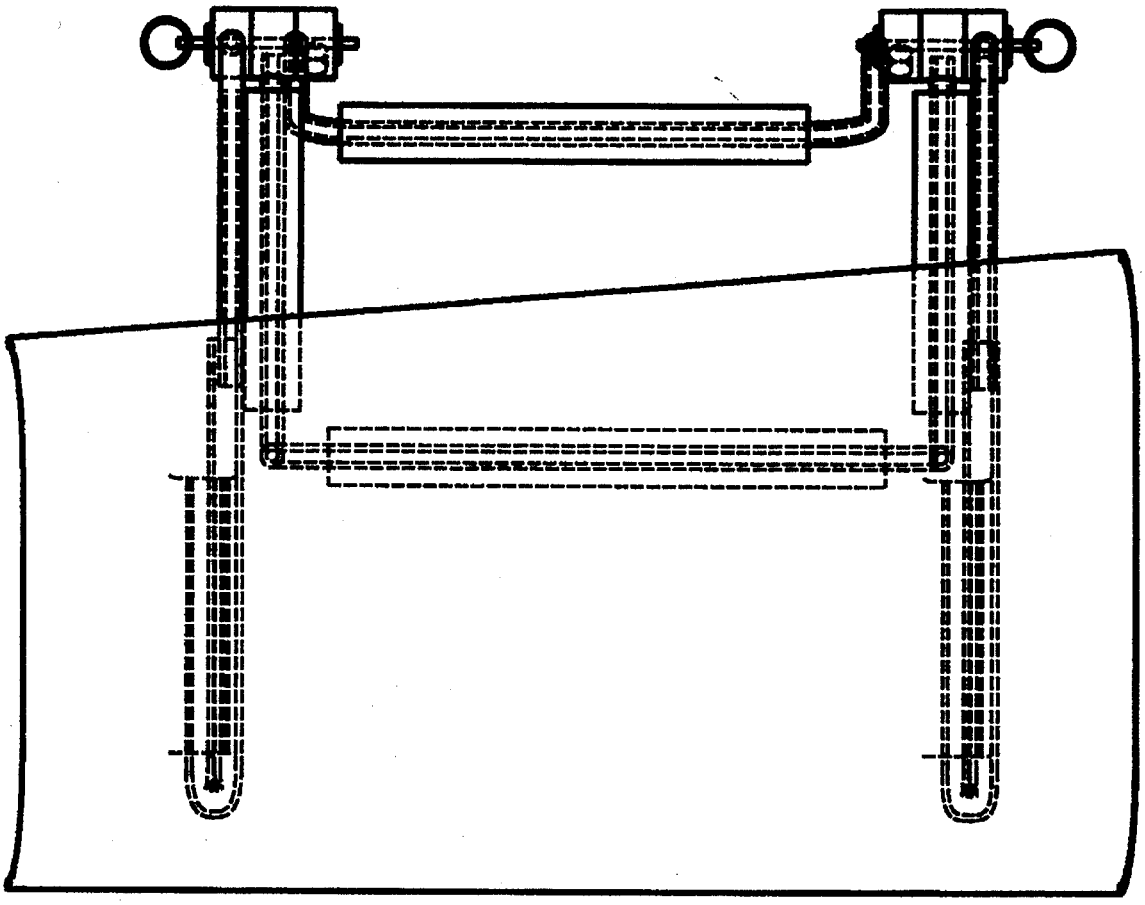
FIG. 3 is a front-elevational view of a Light Weight Portable Snow Plow.
Figure 4:
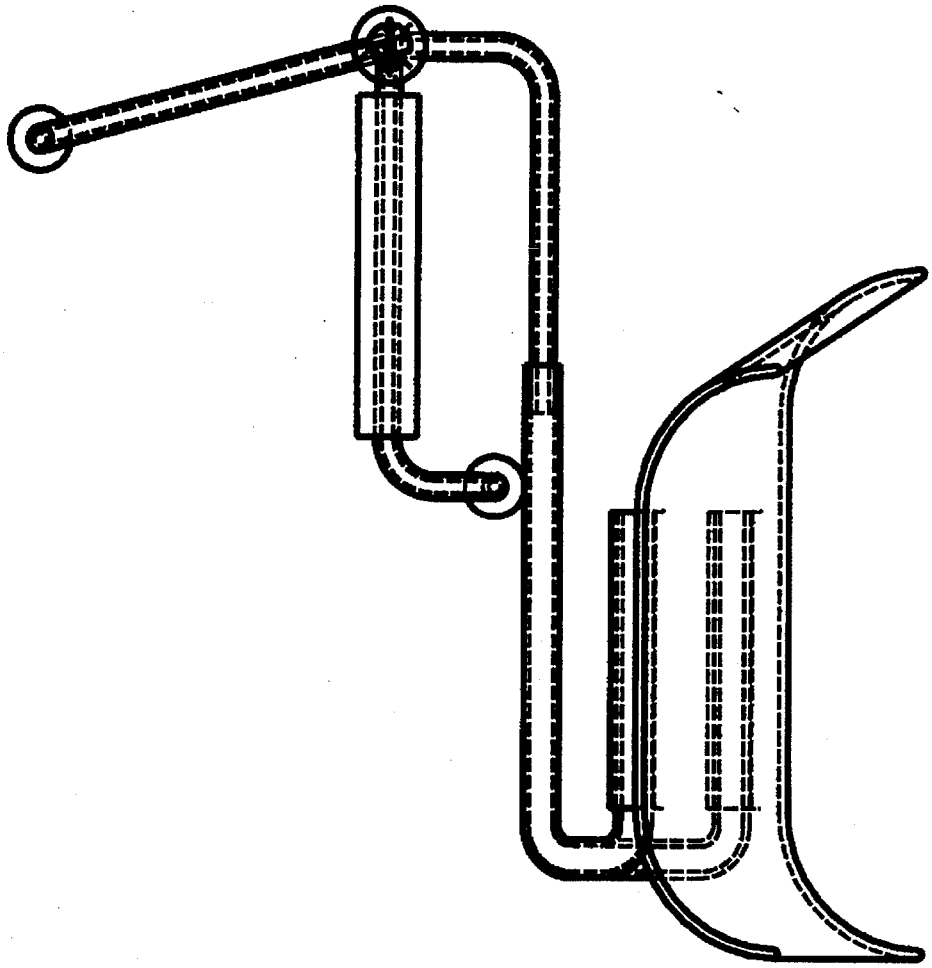
FIG. 4 is a right-elevational view of a Light Weight Portable Snow Plow.
Figure 5:
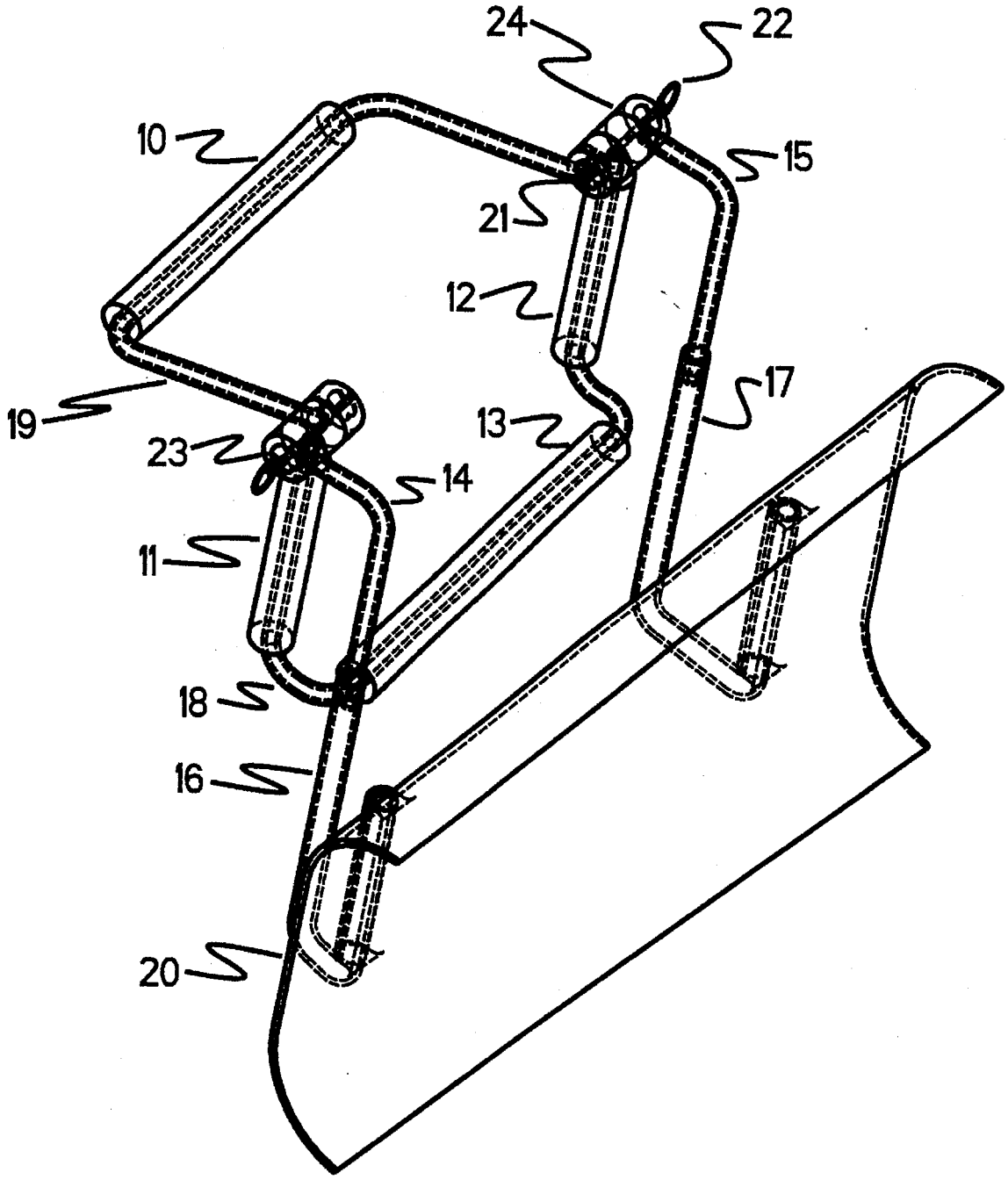
FIG. 5 is a detailed perspective view of a Light Weight Portable Snow Plow.
Figure 6:
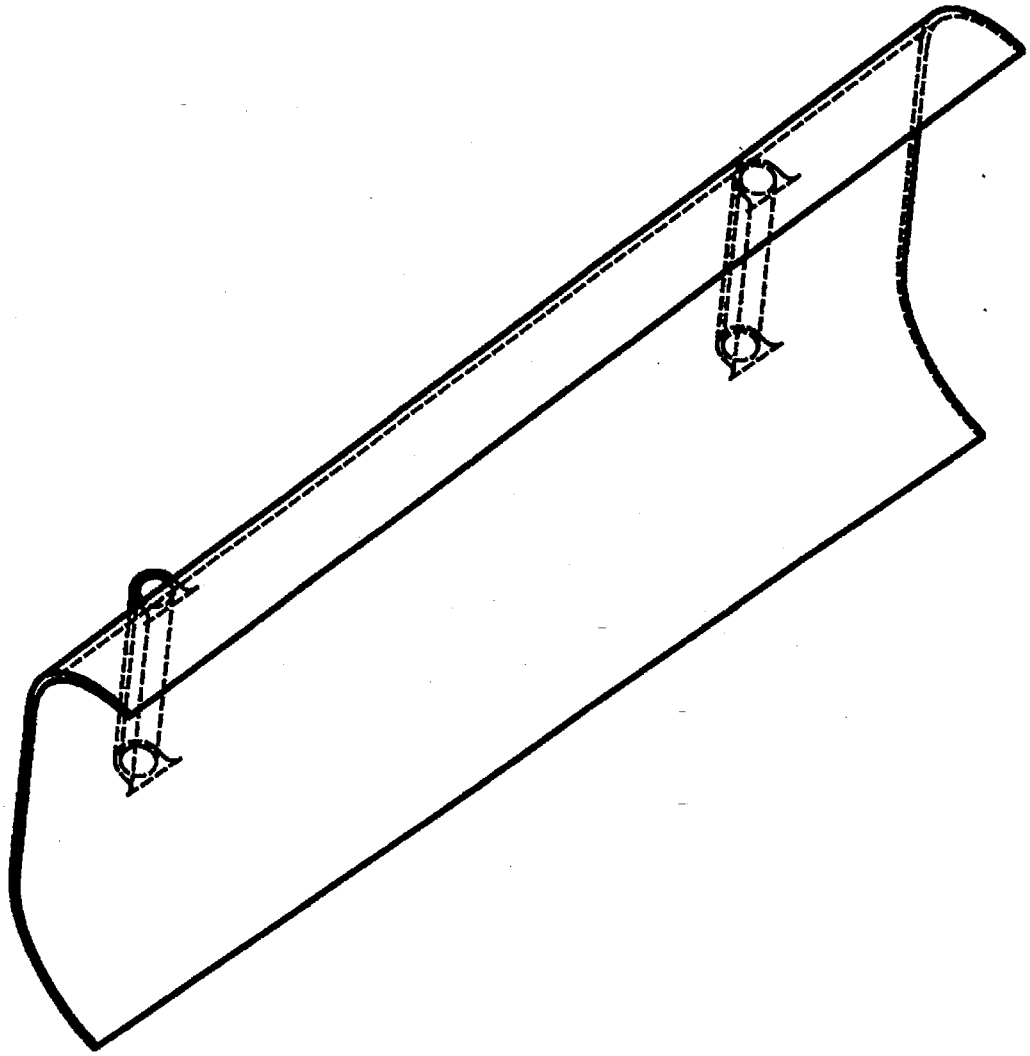
FIG. 6 is a detailed perspective view of a Light Weight Portable Snow Plow blade.
Figure 7:
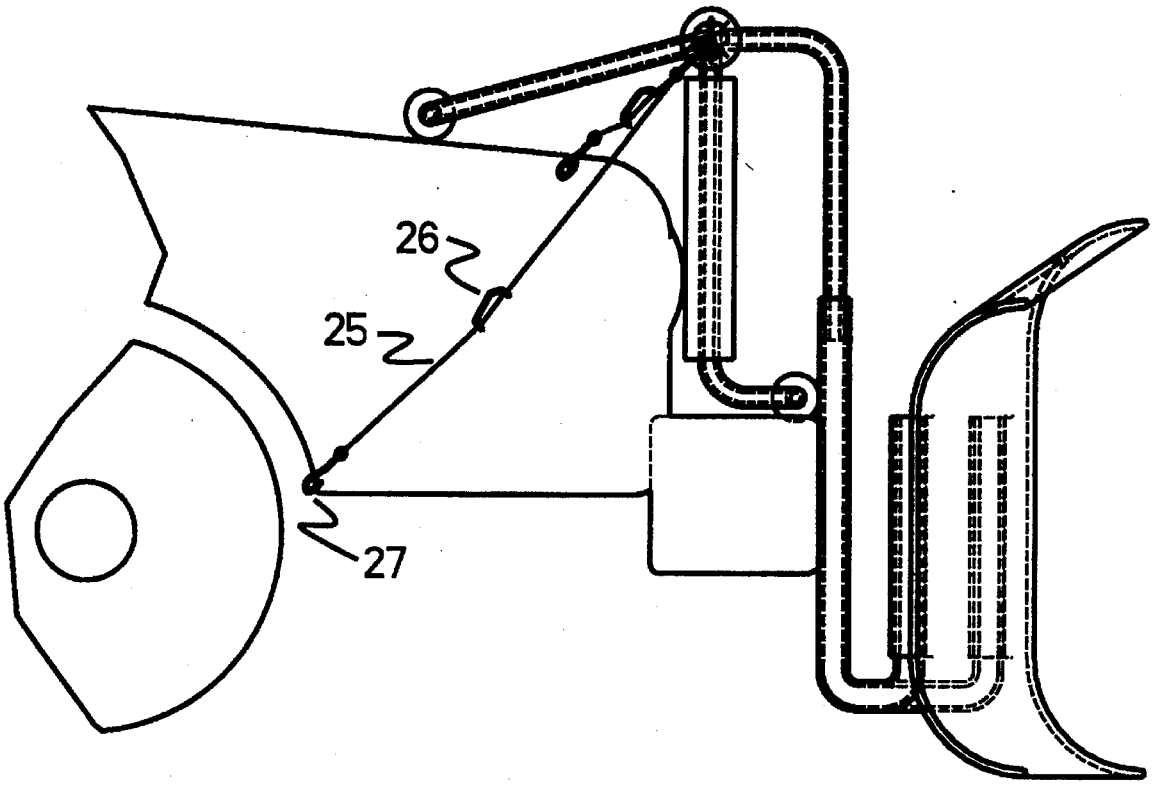
FIG. 7 is a right-elevational view of a Light Weight Portable Snow Plow installed on an ordinary automobile.

Referring now to the drawings in detail, FIGS. 1, 2, 3, 4, 5, 6, and 7 depict various views of a preferred embodiment of the invention. FIGS. 1, 2, 3, 4, and 5 depict various views of the snow plow assembly, FIG. 6 depicts just the snow plow blade, and FIG. 7 depicts the snow plow assembly installed on a vehicle.

Referring now to FIG. 5, the snow plow assembly consists off our support arm cushions, 10, 11, 12, and 13, two upper-vertical support arms, 14 and 15, two lower-vertical support arms, 16 and 17, two horizontal support arms, 18 and 19, one plow blade, 20, two shear pin nuts, 21, two shear pins, 22, four domed washers, 23, six radially-ribbed hubs, 24, and four strap assemblies each consisting of one strap, 25, one strap buckle, 26, and two strap hooks, 27.

The support arm cushions are installed on the support arms as shown. The two upper-vertical support arms, 14 and 15, each consists of a single piece of tubing formed into an L-shape with a radially-ridged hub, 24, on one end. The two lower-vertical support arms, 16 and 17, each consists of a single piece of tubing formed into a U-shape. The inside diameter of the lower-vertical support tubing is slightly larger the outside diameter of the upper-vertical support tubing allowing the two upper -vertical support arms to be inserted in the two lower-vertical support arms. The two horizontal support arms, 16 and 17, each consists of a single piece of tubing with radially-ridged hubs, 24, on both ends. The ridged hubs on the vertical arms mate with the ridged hubs on the horizontal arms as shown. The hubs of the various supports are held together by means of the shear pins, 22, shear pin nuts 21, and domed washers, 23. The shear pins, 22, are threaded at one end to accept the shear pin nuts, 21, and have an eye at the other end where the strap assemblies connect. The shear pins, 22, have been scored so as to readily break when an excessive shear load is encountered, as might be expected if a large immovable object were struck by the plow. Domed washers, 23, are used to provide a load on the threads after hand tightening.

The straps, 25, are connected to the strap hooks, 27, at each end. The straps, 25, are threaded through the buckles, 26, before being attached to the hooks, 27.

Referring now to FIG. 6, the snow plow blade, 20, consist of a single piece blade with two support arm guides molded onto the back of the blade. These support arm guides are slightly larger in diameter than the support arms allowing the blade to be lifted and placed on the free ends of the two lower-vertical support arms. The bottom lip of the snow plow blade is curved slightly upward so that as the blade is pushed along the ground, the snow plow assembly will glide over small obstacles.

OPERATION

Referring to FIG. 5, 6, and 7, the nuts, 21, are loosened so that the vertical and horizontal arms can be adjusted. The horizontal and vertical arms are adjusted as needed to fit individual automobiles. The top support arm, 19, is positioned to rest on top of the automobile hood. The bottom support arm, 18, is adjusted to ride on top of the automobile bumper. The left and fight supports, 14, 15, 16, and 17, are adjusted to rest against the automobile bumper. The shear nuts, 21, are then tightened. The strap hooks, 27, are then attached to either the hood, wheel wells, or any other crack or crevice on the automobile. The slack in the straps is then removed by use of the strap buckles, 26.

The snow plow assembly is then ready to be used. To clear the driveway, the user need only drive the automobile out of the driveway. The snow plow blade can easily be lifted off the vertical support arms to be stored for future use.

SUMMARY, RAMIFICATIONS, AND SCOPE

Accordingly, the reader will see that this invention has the following advantages:

* it provides a Light Weight Portable Snow Plow that can be easily installed and removed;
* it provides a Light Weight Portable Snow Plow that can be installed with no tools;
* it provides a Light Weight Portable Snow Plow that can be attached to a variety of different automobile bumpers;
* it provides a Light Weight Portable Snow Plow whose shape plows snow to one side of the driveway;
* it provides a Light Weight Portable Snow Plow constructed of one piece molded plastic;
* it provides a Light Weight Portable Snow Plow whose bottom lip is designed to push the plow upward if a small obstacle is encountered;
* it provides a Light Weight Portable Snow Plow that is installed using hardware similar to portable bicycle mounts;
* it provides a Light Weight Portable Snow Plow constructed of inexpensive materials using inexpensive manufacturing techniques allowing for a very low retail price.
* to provide a Light Weight Portable Snow Plow that can easily be installed by any member of the household;
* to provide a Light Weight Portable Snow Plow whose attachment to the vehicle is done through "shear pins" that are designed to break if an obstacle is encountered, preventing damage to the vehicle.

Although the description above contains many specifications, these should not be construed as limiting the scope of the invention but as merely providing illustrations of some of the presently preferred embodiments of this invention. For example, the Light Weight Portable Snow Plow might be altered with respect to its dimensions and materials and still be within the scope of this invention.

Thus the scope of the invention should be determined by the appended claims and their legal equivalents, rather than by the example given.

I claim:

1. In combination with a snow plow assembly and a vehicle having a hood and a bumper, the snow plow assembly comprising: a one piece plastic blade and a frame assembly consisting of;

a first U-shaped support member existing in a substantially horizontal plane and having a first tubular support member cushion slidably installed at a midportion of the first support member, a second U-shaped member having two leg portions and a cross portion wherein the two leg portions exist in a substantially vertical plane and the cross portion exists in a second vertical plane disposed from that of the two leg portions, each of the two leg portions and the cross portion having one each of a slidably installed tubular cushion;

two lower vertical supports having upper ends and lower ends wherein the lower ends are in an operational connection to said one piece plastic blade and the upper ends are in telescopically adjustable connection to two upper vertical supports, wherein;

said first U-shaped support member, said second U-shaped member and the two upper vertical supports being interconnected at least one point by a connection means;

the connection means having a plurality of radially ribbed hubs which are held in a mating relationship by means of a looped shear pin capable of failure upon exceeding a predetermined force on either the blade or the frame assembly;

strap means for connection between the looped shear pin and the vehicle in order to securely fasten the snow plow assembly to the hood and the bumper of the vehicle.

* * * * *